US011594827B2

(12) United States Patent
Nguyen et al.

(10) Patent No.: US 11,594,827 B2
(45) Date of Patent: Feb. 28, 2023

(54) CONTACT FOR DIRECT PLUG CONNECTOR AND DIRECT PLUG CONNECTOR

(71) Applicant: Würth Elektronik eiSos GmbH & Co. KG, Waldenburg (DE)

(72) Inventors: Anh-Nguyen Nguyen, Schwäbisch (DE); Daniel Kübler, Sulzbach (DE); Michael Brodbeck, Ammertsweiler (DE)

(73) Assignee: WÜRTH ELEKTRONIK EISOS GMBH & CO. KG, Waldenburg (DE)

( * ) Notice: Subject to any disclaimer, the term of this patent is extended or adjusted under 35 U.S.C. 154(b) by 0 days.

(21) Appl. No.: 17/253,227

(22) PCT Filed: Jun. 19, 2019

(86) PCT No.: PCT/EP2019/066152
§ 371 (c)(1),
(2) Date: Dec. 17, 2020

(87) PCT Pub. No.: WO2019/243401
PCT Pub. Date: Dec. 26, 2019

(65) Prior Publication Data

US 2021/0280994 A1 Sep. 9, 2021

(30) Foreign Application Priority Data

Jun. 22, 2018 (DE) ..... 102018210237.6

(51) Int. Cl.
*H01R 4/2452* (2018.01)
*H01R 12/58* (2011.01)

(52) U.S. Cl.
CPC ..... *H01R 4/2452* (2018.01); *H01R 12/585* (2013.01)

(58) Field of Classification Search
CPC ... H01R 4/2454; H01R 12/515; H01R 12/585
See application file for complete search history.

(56) References Cited

U.S. PATENT DOCUMENTS 4,363,529 A 12/1982 Loose
5,820,402 A * 10/1998 Chiacchio ..... H01R 4/2462 439/398

(Continued)

FOREIGN PATENT DOCUMENTS

CN 1043043 A 6/1990
DE 1915571 U 5/1965

(Continued)

*Primary Examiner* — Jean F Duverne
(74) *Attorney, Agent, or Firm* — Boyle Fredrickson S.C.

(57) ABSTRACT

The invention relates to a contact for a direct plug-in connector having two strips made of sheet-metal material that are arranged next to one another in an insertion portion and in a contact portion, wherein the insertion portion is provided for insertion into a through-opening, which is electrically conductive at its inner wall, in a printed circuit board and the contact portion is provided to make electrical contact with the inner wall of the through-opening, wherein the two strips are connected together in a connection portion that is provided for connecting to a cable strand, and wherein a connecting portion is located between the connection portion and the contact portion, wherein the two strips are located in a common plane and formed in an L-shaped manner in the connecting portion, wherein the legs of the connecting portion that proceed from the connection portion extend parallel to one another and the legs of the connecting portion that are connected to the contact portion extend towards one another.

9 Claims, 8 Drawing Sheets

(56) References Cited

U.S. PATENT DOCUMENTS

| | | | | |
|---|---|---|---|---|
| 6,080,008 | A * | 6/2000 | Frantz | H01R 4/4881 439/441 |
| 10,797,415 | B2 * | 10/2020 | Brodbeck | H01R 12/70 |
| 2015/0229056 | A1 * | 8/2015 | Morello | H01R 13/113 439/370 |
| 2019/0109395 | A1 * | 4/2019 | Geske | H01R 4/4836 |

FOREIGN PATENT DOCUMENTS

| | | | |
|---|---|---|---|
| DE | 68921987 | T2 | 8/1995 |
| EP | 0045153 | A1 | 2/1982 |
| JP | S5753074 | A | 3/1982 |
| JP | H0267566 | U | 5/1990 |
| JP | 2019516223 | A | 6/2019 |
| TW | 201530940 | A | 8/2015 |
| WO | 9005392 | A1 | 5/1990 |
| WO | 2017081194 | A1 | 5/2017 |
| WO | 2017182633 | A1 | 10/2017 |

* cited by examiner

CONTACT FOR DIRECT PLUG CONNECTOR AND DIRECT PLUG CONNECTOR

FIELD OF THE INVENTION

The invention relates to a contact for a direct plug-in connector having two strips made of sheet-metal material that are arranged next to one another in an insertion portion and in a contact portion, wherein the insertion portion is provided for insertion into a through-opening, which is electrically conductive at its inner wall, in a printed circuit board and the contact portion is provided to make electrical contact with the inner wall of the through-opening, wherein the two strips are connected together in a connection portion that is provided for connecting to a cable strand, and wherein a connecting portion is located between the connection portion and the contact portion.

BACKGROUND

The invention also relates to a direct plug-in connector having at least one contact according to the invention.

SUMMARY

With the invention, a contact for a direct plug-in connector and a direct plug-in connector are intended to be shortened in the plug-in direction compared with conventional contacts.

According to the invention, for this purpose, a contact having the features of Claim 1 and a direct plug-in connector having the features of Claim 9 are provided. Advantageous developments of the invention are mentioned in the dependent claims.

The contact according to the invention for a direct plug-in connector has two strips made of sheet-metal material that are arranged next to one another in an insertion portion and in a contact portion. The insertion portion is provided for insertion into a through-opening, which is electrically conductive at its inner wall, in a printed circuit board. The contact portion is provided to make electrical contact with the inner wall of the through-opening. The two strips are connected together in a connection portion that is provided for connecting to a cable strand. A connecting portion is located between the connection portion and the contact portion. The two strips are formed in an L-shaped manner in the connecting portion. The legs of the connecting portion that proceed from the connection portion can extend parallel to one another. The legs of the connecting portion that are connected to the contact portion extend towards one another.

As a result of such a geometric configuration of the contact, the contact can be shortened in the plug-in direction compared with conventional contacts. As a result of the L-shaped configuration of the connecting portions, a sufficient spring action of the contact is nevertheless achieved, in order to attain a secure electrical contact when it is plugged into a through-opening in a printed circuit board. The two strips can lie in a common plane in the connecting portion. As a result, the contact can be produced very easily, since the two strips merely have to be punched out in the connecting portion and do not additionally have to be bent.

In a development of the invention, the legs of the connecting portion that are connected to the contact portion are arranged in a manner aligned with one another. Consequently, the legs connected to the contact portion extend towards one another and are arranged in the same common plane. As a result, symmetric conditions can be achieved as regards the spring properties of the two strips.

In a development of the invention, an arcuate indentation or recess is provided in each case between the connection portion and a respectively internal side edge of the two strips of the connecting portion, wherein the internal side edges face one another.

By means of such an arcuate indentation or recess, a spring rate of the two strips can be set upon deformation relative to the connection portion. In this case, the shaping of the indentions and/or the location of the vertices of the indentations can be changed in order to achieve a different spring rate.

In a development of the invention, the two strips are located in a common plane in the connecting portion and in the insertion portion.

In a development of the invention, the two strips are located, in the contact portion, in the common plane of the connecting portion and of the insertion portion.

In a development of the invention, the connection portion has a plate-like region connecting the two strips, said plate-like region being located in a common plane with the connecting portion.

In this way, the contact can be produced easily from a two-dimensional sheet-metal material.

In a development of the invention, the connection portion has an insulation-displacement connection.

Such an insulation-displacement connection can be easily realized for example in that, starting from a plate-like region, four protrusions are bent upwards through 90°, wherein in each case two protrusions then realize an insulation-displacement terminal between one another.

In a development of the invention, the contact is produced integrally from a two-dimensional sheet-metal material.

The contact according to the invention can be produced from a two-dimensional sheet-metal material by a simple punching operation and optionally a subsequent bending operation. The bending operation is necessary to form the connection portion, for example when an insulation-displacement connection or a crimp connection or a connection portion formed in some other way is intended to be produced.

The invention also relates to a direct plug-in connector having at least one contact according to the invention and a housing for receiving the contact, wherein the contact is received in the housing with play such that a spring movement of the connecting portion is allowed upon insertion of the insertion portion and of the contact portion into a through-hole of a printed circuit board.

As a result of the contact being received with play, it is possible to ensure that the contact region can yield slightly upon insertion into a through-opening in a printed circuit board. The reception with play occurs advantageously in the region of the connecting portion. The contact portion and the insertion portion are located outside the housing and a spring movement of the insertion portion and of the contact portion upon introduction into a through-opening in a printed circuit board is allowed by a deformation or movement of the connecting portion. By contrast, in the region of the connection portion, the contact can be fixed relative to the housing.

In a development of the invention, the contact is received in the housing with play in a direction perpendicular to the plug-in direction.

In this way, not only can the spring movement of the contact portion and of the insertion portion be allowed, but also, at the same time, the contact is movable to a certain extent in the region of the connection portion. This can be used for example in order to insert cable strands particularly easily into connection portions in the form of insulation-displacement contacts. Particularly when a plurality of cable strands are laid and connected at the same time, movability of the contact within the housing makes it easier to lay the cable strands securely.

Further features and advantages of the invention will become apparent from the claims and the following description of preferred embodiments of the invention in conjunction with the drawings. Individual features of the various embodiments illustrated can be combined with one another as desired without exceeding the scope of the invention.

DETAILED DESCRIPTION

Figure 1:
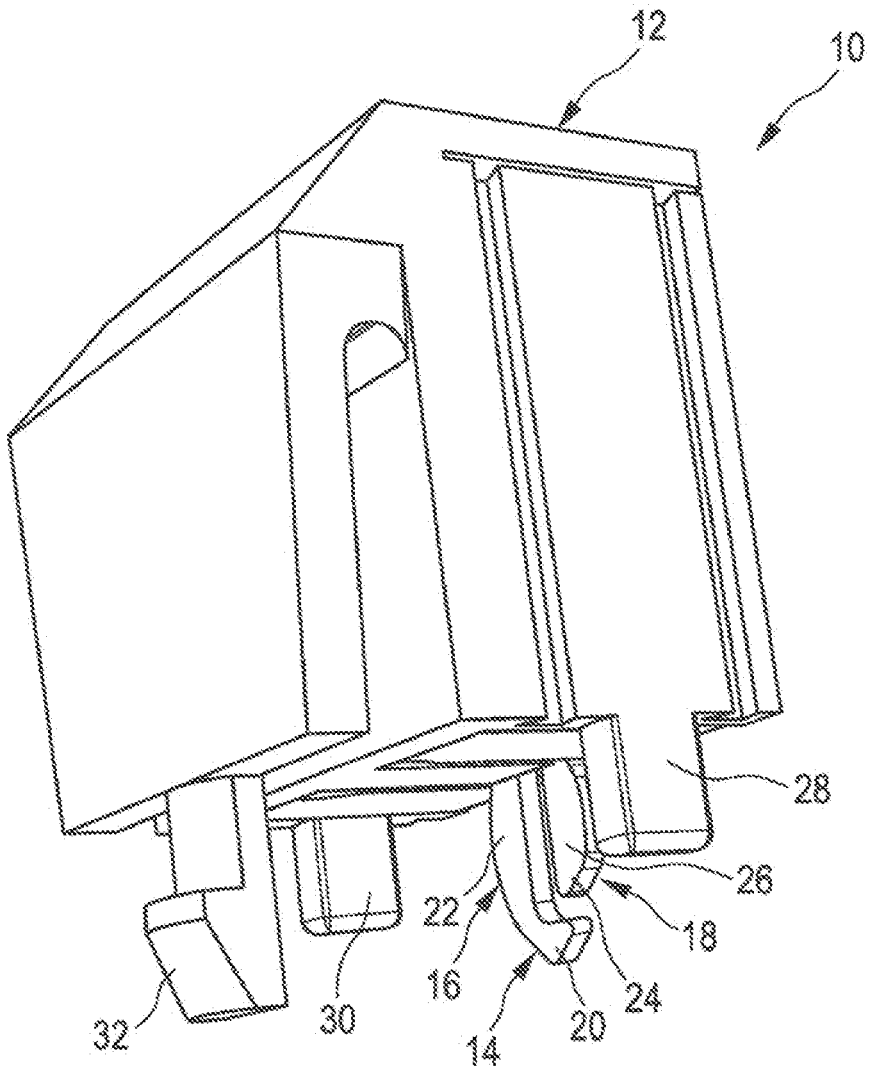
FIG. 1 shows a view of a direct plug-in connector according to the invention obliquely from below.

FIG. 1 shows a view obliquely from below of a direct plug-in connector 10 having a housing 12. A contact 14 projects partially out of the housing. Two strips 16, 18 of the contact 14 project out of the housing, wherein, of the strip 16, an insertion portion 20 and a contact portion 22 and, of the strip 18, an insertion portion 24 and a contact portion 26 are discernible and project out of the housing.

On its underside, out of which the contact 14 also projects, the housing 12 has two positioning protrusions 28, 30 and a latching hook 32. The positioning protrusions 28, 30 and the latching hook 32 are provided to be inserted into matching through-openings in a printed circuit board, in order to orient the housing and thus also the contact 14 relative to a through-opening in the printed circuit board, which is configured in an electrically conductive manner at its inner wall and with which an electrical connection is intended to be established via the contact 14. The latching hook 32 is then provided to hold the housing 12 and the contact 14 on the printed circuit board.

Figure 2:
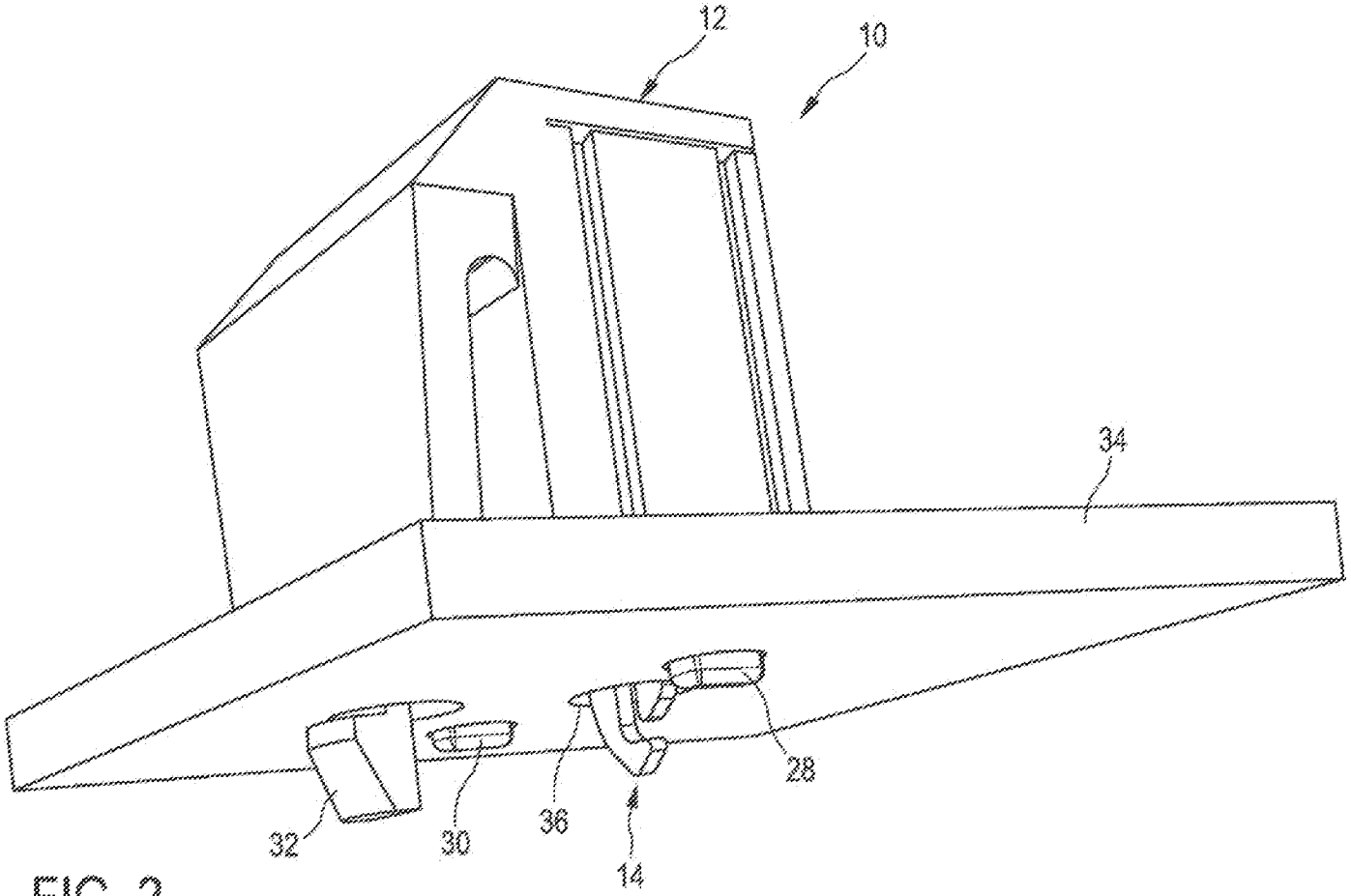
FIG. 2 shows the direct plug-in connector from FIG. 1 in the plugged-in state on a printed circuit board.

FIG. 2 shows a view of the direct plug-in connector 10 in the plugged-in state on a printed circuit board 34. The contact 14 has now been plugged into a through-opening 36 in the printed circuit board, which, as was mentioned above, is configured in an electrically conductive manner at its inner side and is electrically connected to conductor tracks (not illustrated) on or in the printed circuit board 34. The positioning protrusions 28, 30 are each received partially in matching further through-openings in the printed circuit board 34. The latching hook 32 is likewise received in a matching through-opening in the printed circuit board 34. The latching hook engages behind the through-opening and in this way prevents the direct plug-in connector 10 in FIG. 2 from being able to be removed upwardly from the printed circuit board 34. The contact portions 18, 22 of the contact 14 cannot be seen in the illustration in FIG. 2 and bear against the inner wall of the through-opening 36.

Figure 3:
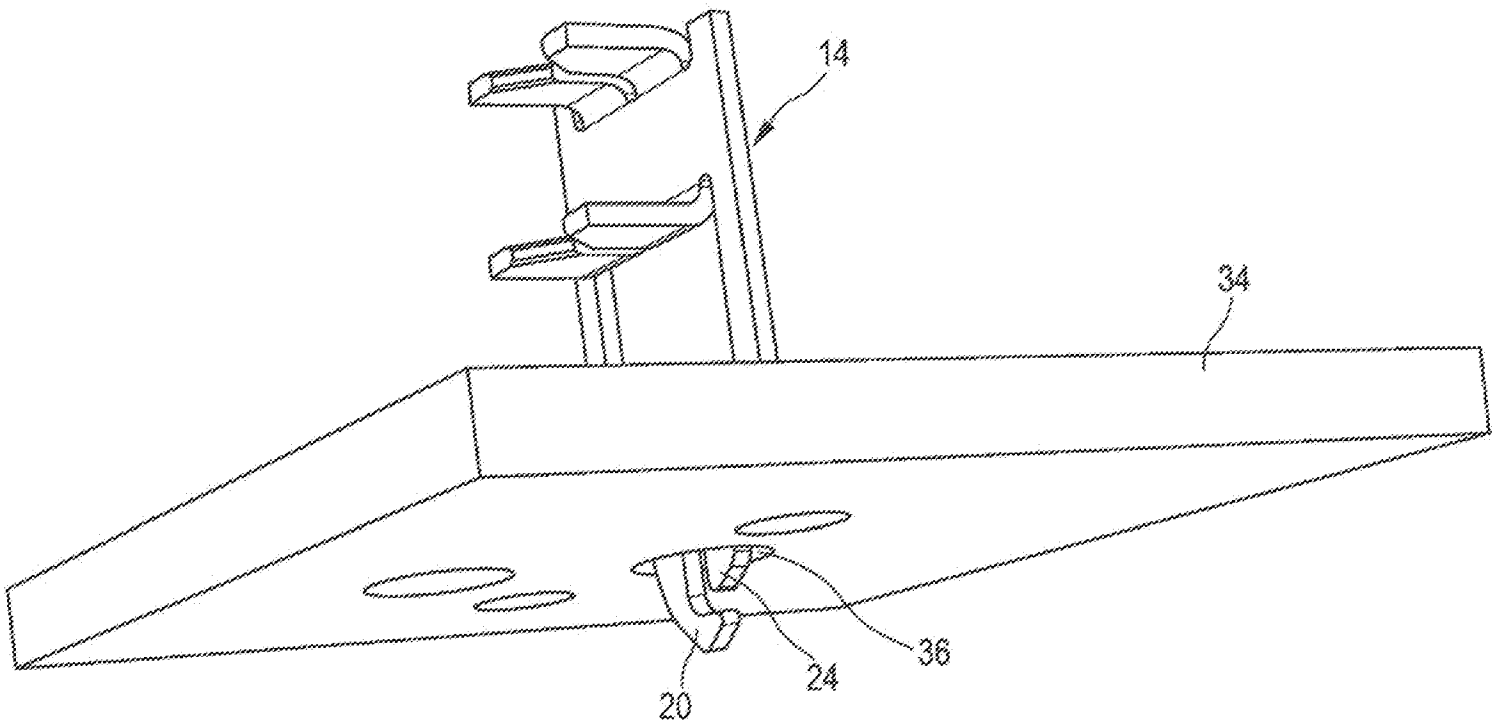
FIG. 3 shows the direct plug-in connector from FIG. 2, wherein the housing has been omitted and only the contact of the direct plug-in connector is shown.

FIG. 3 shows an illustration comparable to FIG. 2, wherein the housing 12 of the direct plug-in connector has been left out entirely. It is now apparent that the contact 14 is arranged merely with its contact portions 18, 22 in the through-opening 36 in the printed circuit board. The two insertion portions 20, 24 are arranged beneath the printed circuit board 34, and the remaining elements of the contact 14, which will be explained below, are arranged above the printed circuit board 34 and in the housing 12.

Figure 4:
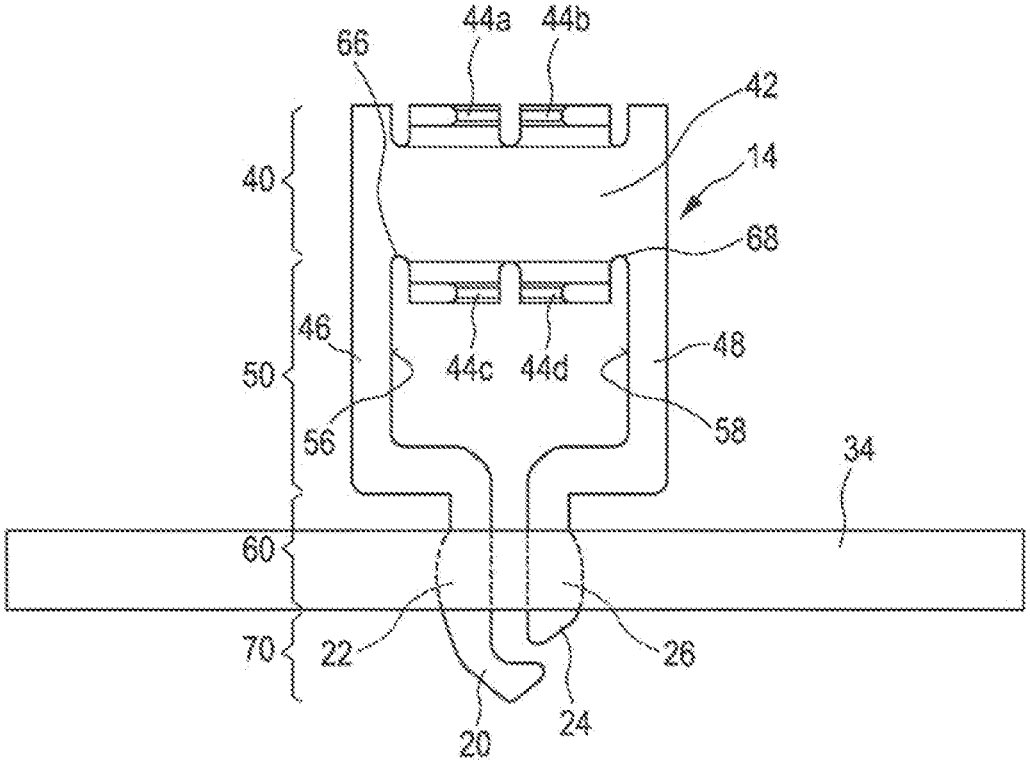
FIG. 4 shows the contact and the printed circuit board from FIG. 3 from a different viewing direction.

FIG. 4 shows the contact 14 and the printed circuit board 34 in a view from the front. In the embodiment illustrated, the contact 14 is produced integrally from a two-dimensional sheet-metal material and has a connection region 40. The connection region 40 has a plate-like portion 42, at the top side and underside of which two protrusions 44*a*, 44*b* and 44*c*, 44*d*, respectively, have been bent away perpendicularly, from the plane of the drawing in the direction of the observer in the illustration in FIG. 4. A slot is formed between in each case two protrusions 44*a*, 44*b* and 44*c*, 44*d*, respectively. As a result, the connection region 40 is configured as an insulation-displacement contact and a cable strand can be inserted into the slot between the protrusions 44*a*, 44*b*, on one side, and 44*c* and 44*d*, on the other side. If the cable strand is then pushed into the image plane in FIG. 4 in the direction of the plate-like portion 42, the insulation of the cable strand is cut and an electrical connection between the conductive cable core and the contact 14 is established. The connection region 40 can also be configured for example as a crimp connection or in some other known way within the scope of the invention.

From the connection region 40 there extend two strips 46, 48, downwardly in the direction of the printed circuit board 34 in FIG. 4. The two strips 46, 48 are then subsequently angled at right angles. As a result, the two strips 46, 48 are both formed in an L-shaped manner. The two strips 46, 48 formed in an L-shaped manner form a connecting region 50.

The connecting region 50 is adjoined by a contact region 60, in which the contact regions 22 and 26 of the contact 14, which are partially concealed in FIG. 4, are arranged. In the region in which the contact regions 22, 26 are concealed by the printed circuit board 34, they are illustrated by dashed lines.

An insertion region 70 of the contact 14 is then arranged beneath the printed circuit board. As already mentioned, the insertion portions 20 and 24 are located in this insertion region.

In the connecting region 50, the two strips 46, 48, starting from the plate-like region 42, initially extend parallel to one another and in a common plane. The in each case second leg of the L-shaped strips 46, 48 then extend towards one another and are likewise arranged in the common plane. The contact portions 22, 26 in the contact region 60 are then again arranged at right angles to the second legs of the strips 46, 48, wherein these are likewise arranged in the common plane. The contact portions 22, 26 do not necessarily have to be arranged in a common plane with the strips 46, 48 in the scope of the invention; the contact portions 22, 26 can, for example, also be twisted with respect to the strips 46, 48 or be arranged in some other way outside the common plane.

In the insertion region 70, the two insertion portions 20, 24 are then again located in a common plane.

It is already apparent from FIG. 4 that, upon insertion of the contact 14 into the through-opening in the printed circuit board 34, the two contact portions 22, 26 can spring inwards, i.e. towards one another in FIG. 4. To this end, the two strips 46, 48 are deflected inwards in the region of their first legs, which are connected to the plate-like portion 42 of the connection region 40. A spring rate of this spring movement is determined inter alia by the transition between the strip 46 and the plate-like portion 42 and the transition between the strip 48 and the plate-like portion 42, respectively. In the embodiment illustrated, an arcuate indentation 66 or 68, respectively, is located between the plate-like portion 42 of the connection region 40 and a respectively internal side edge 56 or 58, respectively. By means of the position and shape of these arcuate indentations or recesses 66, 68, a spring force can be set upon deflection of the strips 46 and 48, respectively, relative to the plate-like portion 42. If the arcuate indentations 66, 68 are shifted somewhat further upwards, for example, in the illustration in FIG. 4, a spring rate between the strips 46, 48 and the plate-like region 42 becomes smaller, and the strips 46, 48 can consequently then be deflected inwards more easily than in the embodiment illustrated in FIG. 4.

It is apparent from FIG. 4 that, compared with conventional direct plug-in contacts, the connecting region 50 can be embodied in a much shorter manner. This is because the two strips 46, 48 are each formed in an L-shaped manner. Nevertheless, a sufficiently large spring movement of the two strips 46, 48 is possible in order, upon insertion of the contact 14 into a through-opening in the printed circuit board 34, to move first of all the insertion portions 20, 24 and then the contact portions 22, 26 inwards, towards one another, and as a result to realize secure insertion and ultimately secure electrical contact.

Figure 5:
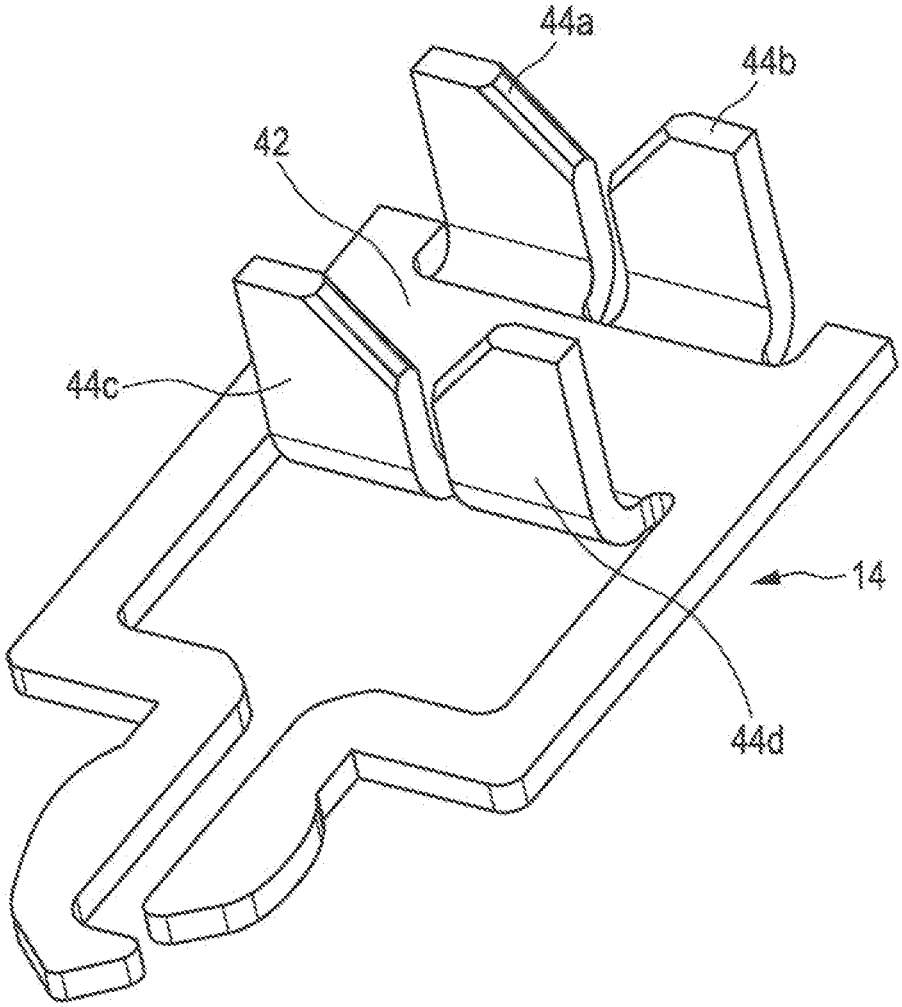
FIG. 5 shows a view of the contact from FIGS. 3 and 4 obliquely from above.

FIG. 5 shows the contact 14 in a view obliquely from above. The contact 14 is formed integrally from one piece of two-dimensional sheet-metal material. The sheet metal material is first of all punched or lasered out and the protrusions 44*a* to 44*d* are then bent perpendicularly upwards from the plate-like region 42, in order to form an insulation-displacement contact.

Figure 6:
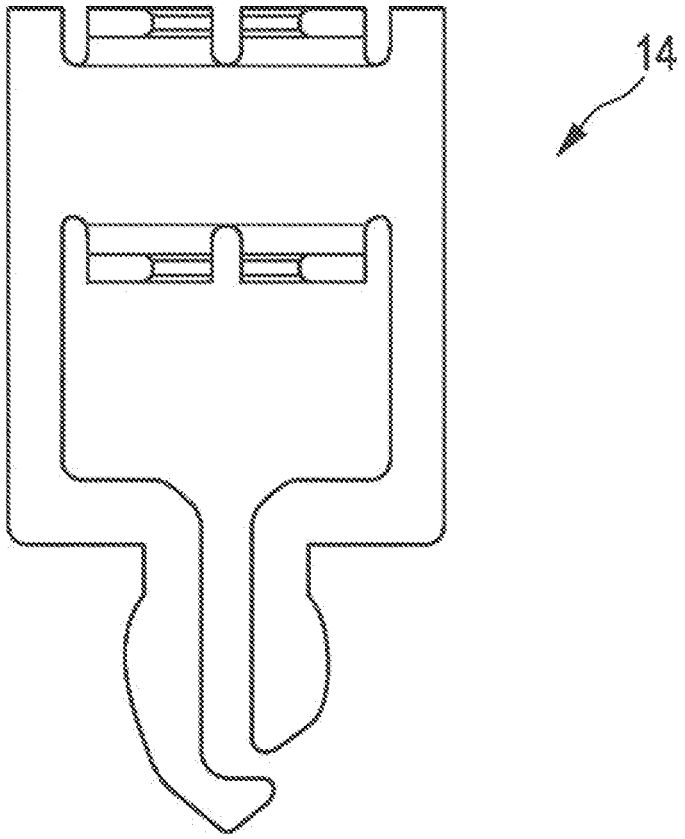
FIG. 6 shows a front view of the contact from FIG. 5.

FIG. 6 shows the contact 14 from FIG. 5 in a view from the front.

Figure 7:
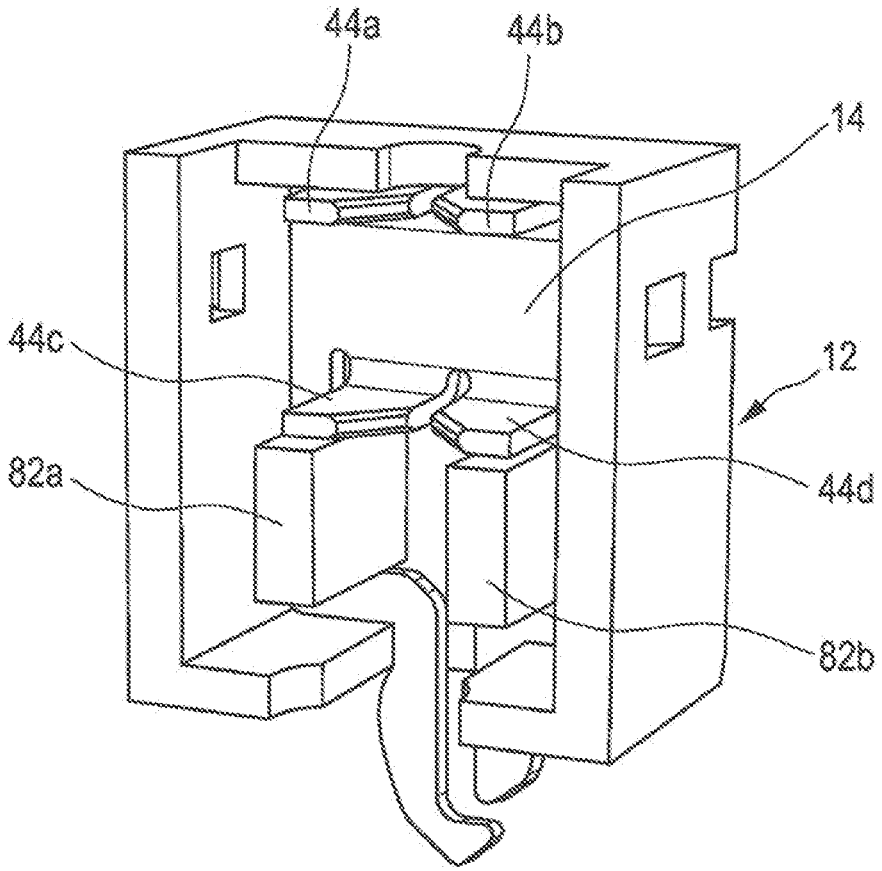
FIG. 7 shows the contact from FIGS. 5 and 6 in the state installed in the housing of the direct plug-in connector.

FIG. 7 shows the contact 14 in the partially opened housing 12. It is apparent that the protrusions 44*a* and 44*b* bear against an inner wall of the housing 12 with their side faces that are arranged at the top in FIG. 7. If the contact 14 is pushed into a through-opening in a printed circuit board, the insertion forces that arise can be absorbed via the protrusions 44*a*, 44*b* and be introduced into the housing 12.

The protrusions 44*c*, 44*d* rest with their side face that is arranged at the bottom in FIG. 7 on protrusions 82*a*, 82*b* of the housing 12. If the housing 12 is removed from a printed circuit board, the tensile forces that then arise can be transmitted, via the side face of the protrusions 82*a*, 82*b* that is arranged at the top in FIG. 7 to the protrusions 44*c*, 44*d*, such that the contact 14 can then be pulled out of the through-opening in the printed circuit board.

Figure 8:
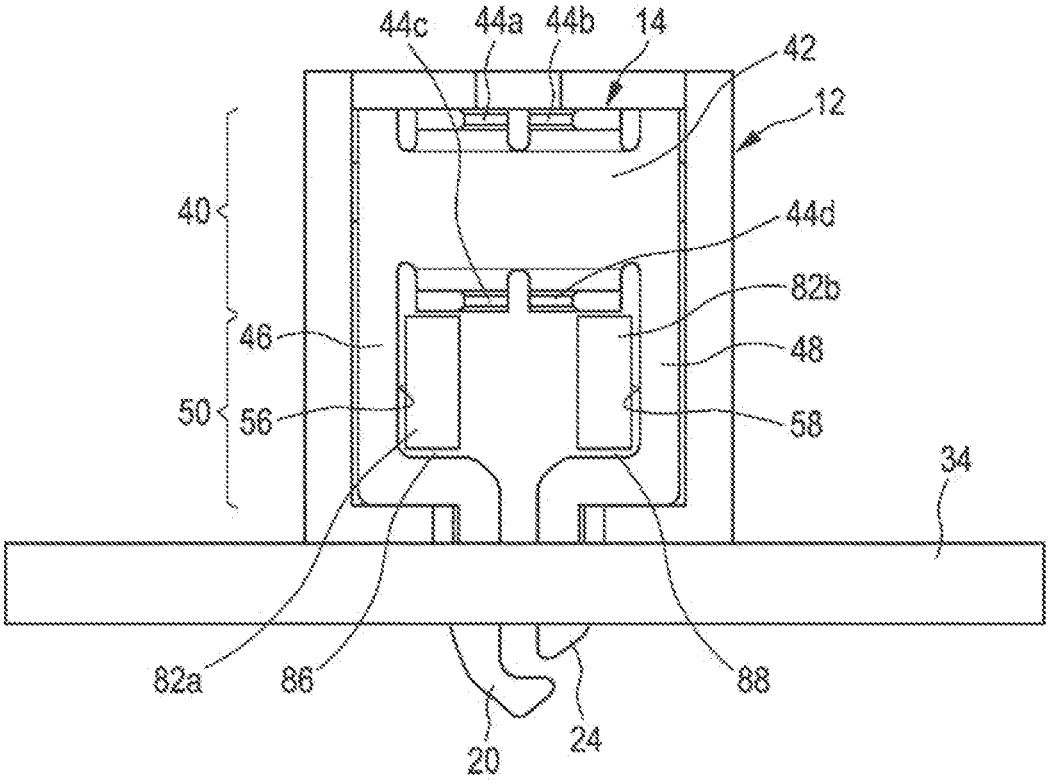
FIG. 8 shows a front view of the housing and the contact from FIG. 7 in the state plugged into a through-opening in a printed circuit board.

FIG. 8 shows the contact 14 and the housing 12 in a view from the front, wherein the contact 14 has been plugged into a through-opening in the printed circuit board 34.

It is apparent from this view that, although the connection region 40 of the contact 14 has been received in the housing 12 in a play-free manner in the plug-in direction by means of the protrusions 44*a*, 44*b*, on the one hand, and counter to the plug-in direction by means of the protrusions 44*c*, 44*d*, on the other hand, as already explained above. However, in a lateral direction, i.e. parallel to the printed circuit board 34, the contact 14 is received in the housing 12 with play and thus in a laterally movable manner. This is apparent from the fact that, between the left-hand side edge of the plate-like portion 42 and the inner wall of the housing 12 and also between the right-hand side edge of the plate-like portion 42 and the right-hand inner wall of the housing 12, there is a spacing. In the connecting region 50, too, there is an equally large spacing between the left-hand side edge of the strip 46 and the right-hand side edge of the strip 48 and the respectively opposite inner wall of the housing 12. Furthermore, the right-hand side edge 56 of the strip 46 is arranged at a spacing from the protrusion 82*a* in the housing 12 and the left-hand side edge 58 of the strip 48 is arranged at a spacing from the protrusion 82*b* in the housing 12. The entire contact 14 can as a result be moved relative to the housing 12 parallel to the printed circuit board 34, i.e., in the illustration in FIG. 8, in a direction from left to right or from right to left. As a result, tolerances can be compensated when cable cores are laid. The entire connection region 40 can yield somewhat to the left or right, should this be necessary when cable cores are laid.

Furthermore, between the upper side edge of the legs, extending towards one another, of the strips 46, 48, which thus extend parallel to the printed circuit board 34 in FIG. 8, and the underside of the protrusions 82*a*, 82*b* in the housing 12 there is also a small spacing, which is indicated by the reference signs 86 and 88 in FIG. 8. The spacing 86 allows a spring movement of the strip 46 upwardly to the right starting from the position illustrated in FIG. 8. Such a spring movement occurs when the insertion portion 20 is deflected inwards, to the right in FIG. 8, upon insertion into the through-opening in the printed circuit board 34. The strip 46 can join in with this spring movement without problems since, as has been explained, the spacing 86 is present and since also the right-hand side edge 56 of the strip 46 is spaced apart from the protrusion 82*a*.

In an analogous manner, the spacing 88 between the underside of the protrusion 82*b* and the upper side edge of the leg, extending parallel to the printed circuit board 34, of the strip 48 allows, in conjunction with the spacing between the left-hand side edge 58 of the strip 48 and the right-hand side face of the protrusion 82*b*, a movement of the strip 48 upwardly to the left when the insertion portion 24 is deflected inwards, i.e. to the left in FIG. 8, upon insertion of the contact 14 into a through-opening in the printed circuit board 34.

As a result of the L-shaped configuration of the strips 46, 48 in the connecting region 50, a considerable shortening of the contact 14 is achieved in the plug-in direction of the contact 14 compared with conventional contacts. At the same time, however, the necessary spring action of the contact portions and of the insertion portions of the contact 14 is allowed in an unchanged manner.

The invention claimed is:

1. A contact for a direct plug-in connector, comprising two strips made of sheet-metal material that are arranged next to one another in an insertion portion and in a contact portion, wherein the insertion portion is provided for insertion into a through-opening, which is electrically conductive at its inner wall, in a printed circuit board and the contact portion is provided to make electrical contact with the inner wall of the through-opening, wherein the two strips are connected together in a connection portion that is provided for connecting to a cable strand, the connection portion including a plate-like portion that defines a common plane across the surface of the plate-like portion and wherein a connecting portion is located between the connection portion and the contact portion, wherein the two strips are formed in an L-shaped manner in the connecting portion, and the legs of the connecting portion that are connected to the contact portion extend towards one another, wherein the two strips are located in the common plane in the connecting portion and in the insertion portion.

2. The contact according to claim 1, wherein the legs of the connecting portion that are connected to the contact portion are arranged in a manner aligned with one another.

3. The contact according to claim 1, wherein an arcuate indentation is provided in each case between the connection portion and a respectively internal side edge of the two strips of the connecting portion, wherein the internal side edges face one another.

4. The contact according to claim 1, wherein the two strips are located, in the contact portion, in the common plane of the connecting portion and of the insertion portion.

5. The contact according to claim 1, wherein the connection portion has a plate-like region connecting the two strips, said plate-like region being located in a common plane with the connecting portion.

6. The contact according to claim 1, wherein the connection portion has an insulation-displacement connection.

7. The contact according to claim 1, wherein the contact is produced integrally from a two-dimensional sheet-metal material.

8. A direct plug-in connector having at least one contact according to claim 1 and a housing for receiving the contact, wherein the contact is received in the housing with play such that a spring movement of the connecting portion is allowed upon insertion of the insertion portion and of the contact portion into a through-hole of a printed circuit board.

9. The direct plug-in connector according to claim 8, wherein the contact is received in the housing with play in a direction perpendicular to the plug-in direction.

* * * * *